United States Patent [19]

Olson

[11] 4,223,190

[45] Sep. 16, 1980

[54] MERCURY FLOAT SWITCH

[76] Inventor: Delwyn L. Olson, 3915 Bamboo Ter., Bradenton, Fla. 33505

[21] Appl. No.: 856,281

[22] Filed: Dec. 1, 1977

[51] Int. Cl.[2] ..... H01H 35/18

[52] U.S. Cl. ..... 200/84 R; 200/61.2; 73/313

[58] Field of Search ..... 73/308, 313, 322.5; 340/244 B, 244 D; 200/84 R, 61.2, 81.6; 174/DIG. 8

[56] References Cited

U.S. PATENT DOCUMENTS

| | | | |
|---|---|---|---|
| 2,816,973 | 12/1957 | Beck | 340/244 B |
| 3,204,232 | 8/1965 | Meyer | 200/84 R |
| 3,518,359 | 6/1970 | Trimble | 174/DIG. 8 |
| 3,543,580 | 12/1970 | McGill | 73/313 |
| 3,568,308 | 3/1971 | Plaskon | 174/DIG. 8 |
| 3,932,853 | 1/1976 | Cannon | 340/244 B |
| 3,944,770 | 3/1976 | Pepper | 200/84 R |

FOREIGN PATENT DOCUMENTS

| | | | |
|---|---|---|---|
| 8908 | of 1912 | United Kingdom | 200/84 R |

*Primary Examiner*—Gerald P. Tolin
*Attorney, Agent, or Firm*—Arthur W. Fisher, III

[57] ABSTRACT

The present invention comprises a Mercury Float Switch that is, a float operable by variations in the water level in the bilge of a boat to control the operation of a bilge pump or control the operation of a sump pump, both operable when the water level in the bilge or sump is above normal. The present float switch comprises a mercury containing tube having two switch contacts extending into one end of the tube which when bridged by the mercury in the tube will cause operation of a bilge pump or a sump pump or the operation of a visible or audible signal. The mercury tube is embedded in a polyurethane foam float which holds it firmly in position and protects it and the contacts from water seepage and corrosion. The tube is bent intermediate its ends at an angle so that the mercury will not be moved to bridge the switch contacts during normal vibration of the tube under normal variance of the water level in the bilge or sump. The float which encloses the tube in polyurethane foam has a hollow shaft made from a substantially rigid material which extends through one end. The float being fixedly attached to the hollow shaft is mounted for pivotal movement on a support bracket about the longitudinal axis of the hollow shaft. The lead wires which conduct the current for controlling operation of the pump or signal extend from each end into the hollow shaft which has an opening cut therein to permit connection of the wires to the switch contacts that extend into the tube. The joints of the conducting wires with the contacts are protected by a suitable epoxy which serves to hold the parts in position as well as to protect the connections of wires and contacts from corrosive materials. The wires extend out the ends of the hollow shaft and have shrinkable sleeves over the ends of the shaft and portions of the wires adjacent thereto to form a seal at this point which prevents moisture leakage into the float as well as to prevent breakage or cracking of the insulation of the wires at these points.

9 Claims, 4 Drawing Figures

MERCURY FLOAT SWITCH

The primary object of this invention is to provide a practical, durable float switch for controlling the operation of bilge or sump pumps or suitable signals which comprises means embodying structural features to prevent on and off operation of a pump, or the like, by the normal movement of the surface of the water on which the float rest, such as by the moving or rocking of a boat.

Another object of the present invention is to provide a float switch structure which embodies protective means and seals to prevent deterioration of the switch structure due to leakage of moisture into the switch structure certain of said sealing means also serving to prevent breakage or cracking of the insulation on the wires to the pump or the like, the operation of which the switch controls.

With these and other objects in view, as may appear from the accompanying specification, the invention consists of various features of construction and combination of parts, which will be first described in connection with the accompanying drawings showing a Mercury Float Switch of a preferred form embodying the invention and the features forming the invention will be specifically pointed out in the claims.

Figure 1:
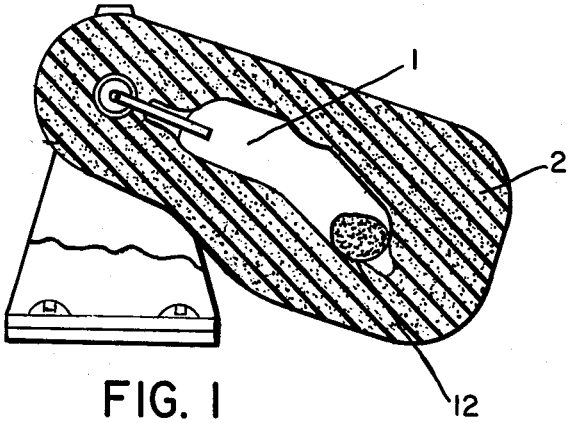
FIG. 1 is a vertical longitudinal section through the switch structure.

Referring more particularly to the drawings, the switch assembly includes a mercury tube 1 in which a globule of mercury 12 is contained. The mercury tube 1 has two switch terminals or contacts 4 in one end thereof. A wire support means for the electrical lead wires is mounted to support the lead wires on the interior of the float body at least at a point of junction of the lead wires to the contacts 4 within mercury tube 1. Support means has a hollow configuration at least in part and is further structured and configured in joining in communicating relation to the mercury tube 1. Interconnection between lead wires 3, supported at least in part on the interior of the wire support means, and contacts 4 is provided through an open portion or aperture in the wire support means. In one embodiment the wire support means includes a hollow shaft 5 being substantially fixedly attached to and extending through one end of float 2 and is further disposed relative to support brackets 8 and 9 to allow pivotal movement of the float about the longitudinal axis of hollow shaft 5 and the lead electrical wires maintained therein. The hollow shaft 5 is attached intermediate its ends to the mercury tube 1 by a moisture proof sealing material 6. The hollow shaft 5 has an opening or slot therein intermediate its ends which opens laterally through the wall of the hollow shaft 5. Lead wires 3 which connect the switch assembly to a pump or signal (not shown) extend one into each end of the hollow shaft and out through the lateral opening in the shaft and are connected to the terminals or contacts 4. The epoxy sealing material 6 which serves to connect the mercury tube 1 to the hollow shaft 5 also encloses and seals the connections between the wires 3 and the contacts 4 from mositure and thus, serves to connect the tube 1 shaft 5 and lead wires 3 in a unitary structure. The hollow shaft 5 is preferably made of acrillic plastic or similar material which is impervious to corrosion.

Figure 3:
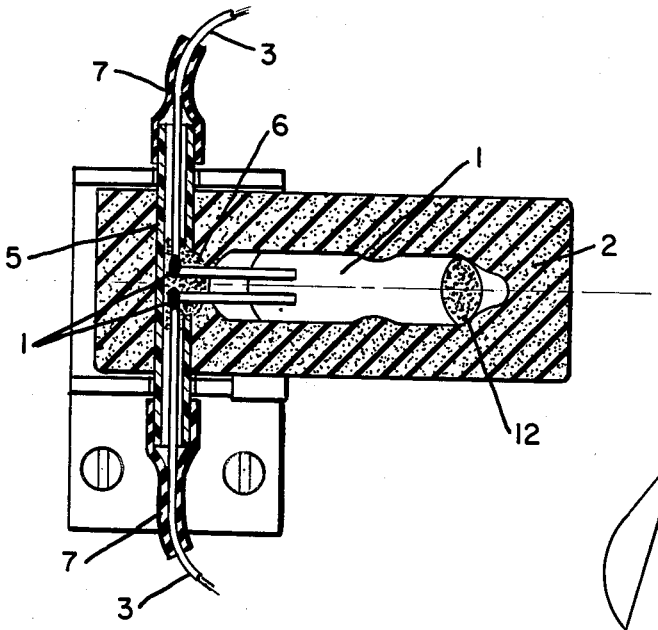
FIG. 3 is a horizontal section through the switch structure.

The lead wires 3 are insulated with neoprene or flexible material that is resistant to salt water and oil. The wires 3 are also sealed at their exit point from the hollow shaft 5 by shrinkable rubber tubing 7 assembled over the ends of the hollow shaft 5 and shrunk onto the wire and shaft ends as shown in FIG. 3 to provide a primary atmospheric seal for preventing moisture entering the shaft 5. This shrink tubing 7 being flexible also acts to prevent severe bending of the lead wires as they enter the shaft 5.

The switch assembly is placed in a cavity formed in a suitable mold (not shown) with end portions of the hollow shaft 5 extending out of the cavity. The cavity in the mold determines the outside shape of the float body 2. After the switch assembly is placed in the cavity of the mold a polyurethane foam being a two part liquid which is premixed is introduced into the mold and which subsequently forms around the switch assembly filling the mold cavity and embedding the switch therein. The liquid polyurethane injected into the cavity (not shown) solidifies into a solid light weight body which will readily float on the surface of water.

Figure 2:
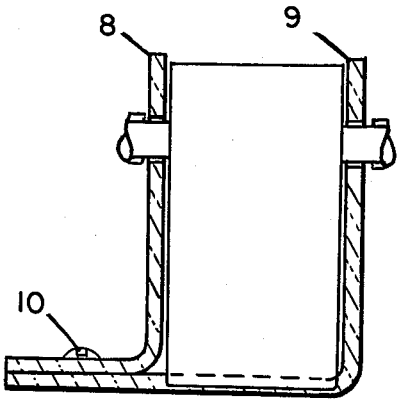
FIG. 2 is a vertical view of the switch structure taken at right angles to that shown in FIG. 1.

The shaft 5 is rotatably supported by two L-shaped mounting brackets 8 and 9 as shown in FIGS. 2 and 3. Each bracket 8 and 9 includes a horizontal which are clamped together after the spacing include of the upright section has been adjusted for proper float side clearance and alignment of shaft 5. The bases or horizontal portions of the brackets 8 and 9 project laterally from one of the upright section a sufficient distance to provide suitable structure for mounting the floating switch in position for its ultimate use. The lateral projections defining the horizontal bases are mounted one upon the other and are then chemically welded together by applying methylene to their outer edges. When the weld is secure, the clamp is removed and two mounting holes drilled through the two bases to accommodate the mounting screws 10 for attaching the switch to the bottom of the bilge, sump or other sensing points. This feature facilitates assembly of the float assembly to its support brackets and permits easy installation of the switch assembly by giving the installer unrestricted access to the mounting holes for driving the mounting screws.

Figure 4:
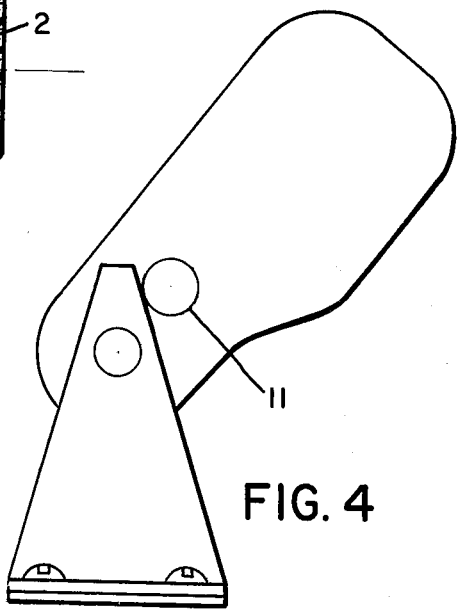
FIG. 4 is a side elevation of the switch structure.

A button or lateral projection 11 is formed projecting from one side of the polyurethane float body 2 during its molding and is positioned to engage the edge of one of the upright sections of the L-shaped brackets 8 or 9 to prevent it from rotating past upper dead center of the brackets as shown in FIG. 4.

As clearly shown in the drawings the switch contacts 4 extend into the mercury tube 1 at one end of the tube in spaced relation so as to normally prevent the closing of the electrical circuit through them. However, when the float assembly 2 rises upwardly, the globule of mercury will engage both contacts 4 and close an electrical circuit through them, the wires 3 and the pump, or the like to which the wires are connected.

To prevent cutting on and off of operation of the bilge pump when the level of water in the bilge is not sufficiently high as to require its pumping, the mercury tube 1 of the present invention is bent intermediate its ends at an angle to what would be the normal straight line of the tube. This requires greater movement of the bent mercury tube before allowing the mercury to engage both contacts 4. Consequently the nuisance and excessive wearing on the bilge pump by the intermittently cutting out and in of its operation is eliminated. The mercury is allowed to move upwardly over the bent inclined portion of the tube 1 only when the water level in the bilge reaches its sufficient height to restore the float assembly towards a maximum vertical position. The mercury remains in such position as to maintain a mercury bridge over the contact and continue operation of the pump until the water level in the bilge or sump falls to its minimal level.

This invention is a simple, inexpensive method of producing a small, reliable, long lasting automatic bilge or sump switch wherein the "glass tube" nercury switch is essentially packaged in polyurethane foam making it indestructable under all normal operating conditions especially in salt water environment which limits the life of conventional switches and under road shock conditions encountered with trailering a boat. Polyurethane foam makes the ideal float material for this application as it is extremely light weight, has a "closed cell" structure that prevents absorption of moisture and is completely resistant to oil and salt water over a wide operating temperature range.

It is important that the lead wires be flexible by using a large number of very fine gauge copper wires as the conductor in order that they transmit no appreciable torque to the float assembly. Insulation material is usually neoprene.

By limiting the bend radius of the lead wires with the flexible shrink tubing the possibility of cracking the insulation due to repeated bending is virtually eliminated. Other designs that permit this severe bend radius have a very limited life in marine applications as this bending causes cracking of the insulation material permitting moisture intrusion with subsequent corrosion of the stranded wires and eventual failure of the switch. Also, as stated, the only corrosion points of this design are the two junctions of the lead wires with the switch terminals, which are sealed with an epoxy or marine sealant. However, moisture should never reach this point as the primary "shrink tubing" seal prevents moisture from entering the inside of the axis tube and the foam material adhering to the outside of the axis tube forms a seal which prevents moisture from penetrating around the outside. These are the only paths for moisture to penetrate to the switch wire junctions as the foam material itself completely seals out moisture. This feature virtually eliminates the possibility of switch failure due to corrosion from salt water or other moisture by requiring a "double seal" failure and preventing cracked lead wire insulation by eliminating all sharp bend radius. As the switch itself imbedded in the foam is essentially indestructable, this design should have an extremely long service life.

It will be understood that the invention is not to be limited to the specific construction or arrangement of parts shown, but that they may be modified within the invention defined in the claims.

What is claimed is:

1. A mercury float switch comprising a float body formed of light, corrosion, resisting foam material, a mounting bracket disposed in supporting engagement relative to said float body, a mercury tube having a globule of mercury contained therein, said mercury tube potted on the interior of said foam material, a pair of switch contacts mounted on the interior of said mercury tube, a hollow shaft attached to said float body and so disposed to have its opposite ends extend outwardly therefrom, said hollow shaft having a slot formed therein intermediate its opposite ends, said slot disposed in communicating relation with said switch contacts, lead electrical wires, one each extending through each end of said hollow shaft and connected to said electrical contacts through said slot, said hollow shaft pivotally mounted on said mouting bracket and fixedly connected in supporting relation to said float body, said hollow shaft and said float body rotatable about the longitudinal axis of said hollow shaft, said globule of mercury disposed to bridge said contacts and electrically interconnect said lead electrical wires upon predetermined pivotal movement of said float body.

2. A mercury float switch as in claim 1 werein said mercury tube is encapsulated on the interior of said foam material in fluid sealed relation to the exterior of said float body.

3. A mercury float switch as in claim 1 wherein said mounting bracket includes at least two upright sections disposed in parallel relation to one another and spaced apart a sufficient distance to have said float body disposed therebetween and pivotally mounted thereon.

4. A mercury float switch as in claim 1 wherein said mercury tube is bent intermediate its ends and is configured for disposal of said mercury globule such that said mercury globule will be prevented from contacting both of said switch contacts until the float body reaches a predetermined position in its upward pivotal movement and will prevent from breaking contact with said switch contacts until the float body reaches a predetermined position in its downward pivotal movement.

5. A mercury float switch as claimed in claim 1, including shrinkable flexible sleeves shrunk over the ends of said hollow shaft and over the portions of the lead wires adjacent their entrance into the hollow shaft for performing a moisture seal at such points and preventing a sharp bend radius of the lead wires.

6. A mercury float switch as claimed in claim 3, including stop means formed on one side of said float for engaging one of said brackets to limit the upward pivotal movement of the float assembly.

7. A mercury float switch as claimed in claim 1, including moisture proof sealing material forming a moisture seal over the connections of the lead wires to the contacts and moisture proof seals formed over the ends of the hollow shaft and the portions of the lead wires adjacent the point of entrance into the hollow shaft whereby a double seal is formed to provide double moisture proofing for the connections of the lead wires and switch contacts.

8. A mercury float switch comprising a float body made of light, corrosion resisting foam, a hollow shaft attached to said float body and so disposed to have its opposite ends extend outwardly therefrom, said float body mounted to pivot with said hollow shaft, a mercury tube potted in said float body and having a globule of mercury therein, a pair of switch contacts extending into said tube, lead electrical wires connected to said contacts, said mercury globule adapted to bridge and connect said contacts, the mercury tube being bent laterally of its normal longitudinal axis to provide a bend in the tube whereby said mercury globule will be held from engaging said switch contacts until said float body reaches a predetermined upper and lower position in its pivotal movement about the hollow shaft, said hollow shaft comprising a hollow tube of marine corrosion resisting materials having a slot therein intermediate its ends and opening laterally into said float body, said lead wires extending into said hollow shaft one from each end thereof and extending inwardly through the slot in said shaft to engage said switch contacts.

9. A mercury float switch comprising a float body made of light, corrosion resisting material, a wire support means disposed at least in part on the interior of said float body, a mercury tube potted in said float body and having a globule of mercury therein, a pair of switch contacts extending into said tube, said wire support means including a substantially hollow configuration and structured and disposed and attached in communicating relation with said mercury tube, lead electrical wires supported by said wire support means on the interior of said float body and disposed in connection with said contacts through an opening in said wire support means, said float body pivotally mounted about said lead electrical wires connected to said float body at least in part by said wire support means disposed at least in part on the interior of said float body, said mercury globule adapted to bridge and connect said contacts, said mercury tube being bent laterally of the normal longitudinal axis to provide a bend in the tube whereby said mercury globule will be held from engaging said switch contacts until said float body reaches predetermined upper and lower positions in its pivotal movement about said lead electrical wires.

* * * * *